United States Patent [19]

Nishikawa et al.

[11] Patent Number: 4,562,825

[45] Date of Patent: Jan. 7, 1986

[54] FLAME-RISE STOPPING MEANS FOR A KEROSENE STOVE

[75] Inventors: Hideo Nishikawa; Kenzo Okamoto, both of Osaka; Hiroichi Sakai, Moriguchi; Fumihiko Kitada, Neyawawa, all of Japan

[73] Assignee: Imanishi Kinzoku Kogyo Kabushiki Kaisha, Osaka, Japan

[21] Appl. No.: 600,865

[22] Filed: Apr. 16, 1984

[30] Foreign Application Priority Data

Jun. 16, 1983 [JP] Japan ..... 58-91235[U]

[51] Int. Cl.[4] ..... F24C 5/04

[52] U.S. Cl. ..... 126/96; 126/83

[58] Field of Search ..... 126/93–97, 126/110 B, 110 R, 84, 83; 431/307, 304, 201, 347

[56] References Cited

U.S. PATENT DOCUMENTS

| | | | |
|---|---|---|---|
| 3,381,678 | 5/1968 | Fry | 126/96 |
| 4,357,929 | 11/1982 | Johnson | 126/96 |

FOREIGN PATENT DOCUMENTS

| | | | |
|---|---|---|---|
| 68519 | 5/1980 | Japan | 126/96 |
| 68520 | 5/1980 | Japan | 126/96 |
| 142131 | 8/1983 | Japan | 126/96 |
| 142132 | 8/1983 | Japan | 126/96 |

*Primary Examiner*—James C. Yeung

*Attorney, Agent, or Firm*—Armstrong, Nikaido, Marmelstein & Kubovcik

[57] ABSTRACT

A flame-rise stopping means for a kerosene stove, comprising an annular reticulate member having an inwardly directed flame at the lower end of the annular member and a holder plate fixed to the underside of the top plate of the stove and serving to removably hold the annular reticulated element above and opposite the chimney of the stove.

2 Claims, 6 Drawing Figures

FLAME-RISE STOPPING MEANS FOR A KEROSENE STOVE

BACKGROUND OF THE INVENTION

The invention relates to a flame-rise stopping means for a reflection-type wick-regulated kerosene stove (referred to simply as "kerosene stove" below).

With the kerosene stove, ignition, extinction and adjustment of flame are effected by altering the height of the wick. When adjusting the flame, a momentary rise of flame is often experienced upon raising the wick to a maximum level after once lowering it. Particularly in an attempt to quickly obtain an appropriate flame at the time of ignition, the wick is often fully raised first, allowing combustion to take place with the highest possible flame and, after a certain space of time, somehwat lowered and then raised again, when the most outstanding rise of flame is liable to occur. Such flame rise is very dangerous as it may reach outside the stove.

The inventors carried out various researches for the way to prevent flame from spreading and found that the spread of flane rise may be completely prevented by providing a reticulated annular element above and opposite the chimmey, said reticulated annular element having an inwardly directed flange at its lower end and secured to a holder plate which has hooks and is fixed to the underside of the top plate of the stove.

DETAILED DESCRIPTION OF A PREFERRED EMBODIMENT

An object of the invention is to provide a flame-rise stopping means for the kerosene stove capable of completely preventing the flame-rise from spreading.

Another object of the invention is to provide an easily detachable flame-rise stopping element for the kerosene stove.

The invention will now be described below with reference to the drawings showing an embodiment of the invention.

DETAILED DESCRIPTION OF A PREFERRED EMBODIMENT

Figure 1:
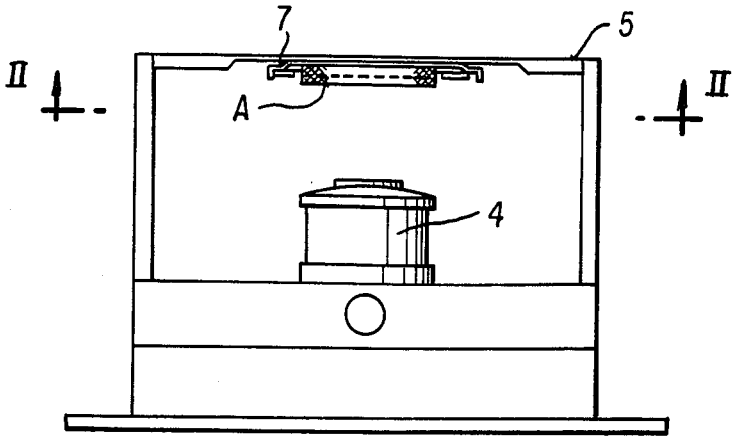
FIG. 1 is a partly sectional elevation diagramatically showing a kerosene stove provided with the flame-rise stopping means according to the invention.
Figure 2:
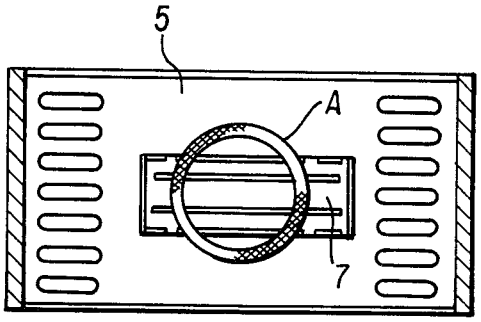
FIG. 2 is a cross section along line II—II on FIG. 1.
Figure 3:
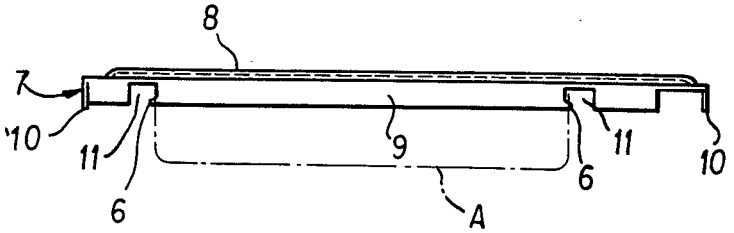
FIGS. 3 and 4 are an elevation and a bottom view of the holder plate, respectively.
Figure 4:
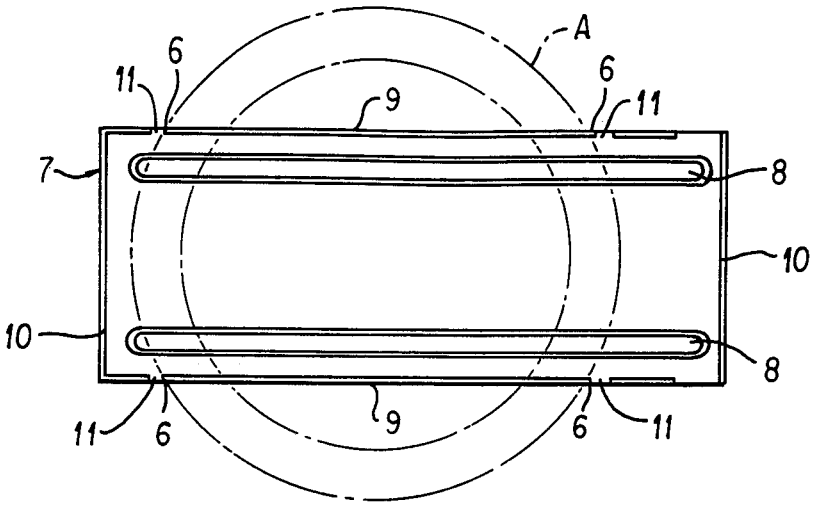

FIGS. 1 and 2 show a reticulated annular flame-rise stopping element A for a kerosene stove according to the invention removably mounted on the underside of a top plate 5 of the stove by means of a holder plate 7 having hooks 6. The reticulated annular element A has an inwardly directed flange 3. The holder plate 7 is a rectangular plate with two projected lines 8 along its length. The holder plate 7 has at its periphery bent sides 9, 10 directed downward. The longitudinal bent sides 9 each have two cuts 11 and those parts of the bent sides 9 between the cuts 11 are each formed at the lower ends of their outer edges with hooks 6. Alternatively the hooks 6 may be formed at the lower ends of the inner edges of those parts of the bent sides 9 outside the cuts 11. As is clear from FIGS. 3 and 4, the hooks 6 are located so as to engage the reticulated flame-rise stopping member A. The holder plate 7 is secured to the top plate 5 with the projected lines 8 in close contact with the underside of the plate 5 and is situated so as to locate the reticulated flame-rise stopping element A almost concentric with the chimney. The holder plate 7 preferably is made of material which has a small heat capacity and a small thermal conductivity.

Figure 5:
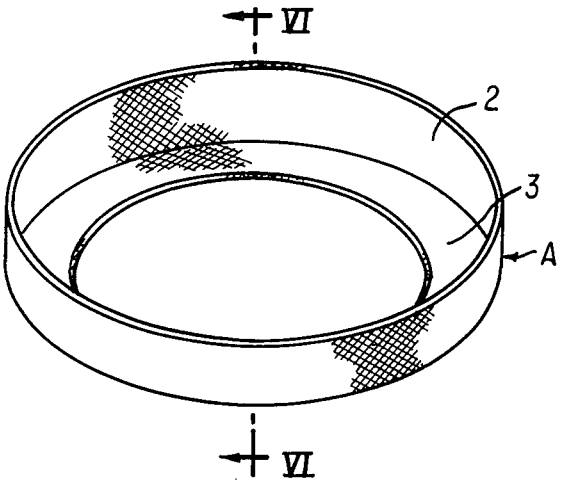
FIG. 5 is a perspective view of the reticulated flame-rise stopping element.
Figure 6:
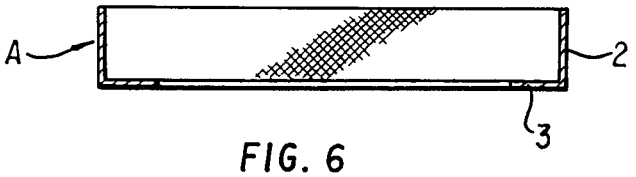
FIG. 6 is a cross section along line VI—VI on FIG. 5.

As shown in FIGS. 5 and 6, the reticulated flame-rise stopping element A is composed of a cylindrical portion 2 having a base and provided at its base with an inwardly directed flange 3. The cylindrical portion 2 has a diameter substantially equal to or slightly larger than the outer diameter of a chimney 4. The reticulated element A of a diameter larger or smaller than that as sepcified above will reduce or kill its flame-rise stopping ability.

The axial length of the cylindrical portion 2 may vary according to the fuel comsumption rate of the stove. For generally used kerosene stoves consuming fuel at a rate of 1500 g/h or fewer, the reticulated element A preferably has an axial length of about 30 mm. The reticulated element A with a shorter axial length hardly afford sufficient flame-rise stopping effect while its longer axial length is not only unnecessary but undesirable in terms of appearance and function. Where the stove is of a type which consumes fuel at a greater rate than specified above, the axial length of the cylindrical portion 2 is varied accordingly.

The flange 3 preferably is extended inward from the cylindrical portion 2 perpendicularly to the portion 2. The flange 3 suitably has a width about $\frac{3}{4}$ to 1 time as large as the axial length of the cylindrical portion 2. A wider or narrower flange 3 will result in insufficient flame-rise stopping ability of the reticulated element 4.

The reticulated element A may be formed of a metal sheet subjected to expansion, or a punched metal sheet or the like, which preferably has a small heat capacity and a small thermal conductivity. Where wire gauze is used, the reticulated element A preferably is of about a 10 to 13-mesh screen, particularly 12-mesh and where other material other than wire gauze is used, the mesh is made substantially equal to that of wire gauze and as uniform as possible.

The reticulated flame-rise stopping element A is fixed to the holder plate 7 with the four hooks 6 which engage meshes of the reticulated element A. The holder plate 7 is previously so located that the recticulated element A, when fixed, is situated almost concentric with the chimney 4.

The flame which rises is confined within the reticulated element and circulates therein so that the heat of the flame is absorbed before they could reach outside and thus goes out in a short period of time. In this way the flames are thorougly kept from spreading out of the stove so the stove may be used in safety. Further the reticulated flame-rise stopping element according to the invention may be attached and detached quite easily, which is convenient for cleaning, for example, as it is liable to be soiled with soot.

We claim:

1. A flame-rise stopping means for a kerosene stove having a chimney and a top plate, comprising:

(a) an annular reticulated flame-rise stopping element having a cylindrical portion with a base, said cylinder having a diameter substantially equal to or slightly larger than the outer diameter of said chimney, and a flange portion extending inwardly substantially at a right angle from the base of the cylindrical member, said flange portion having a width of between 75% and 100% of the axial length of said cylinder, said flame-rise stopping element having a pore size and distribution equivalent to a standard sieve having a mesh designation between 10 and 13; and (b) a holder plate secured to a position at the underside of the top plate of the stove directly above the chimney and having a plurality of hooks formed therein for removably mounting the reticulated element by engagement therewith.

2. A flame-rise stopping means according to claim 1, wherein the annular reticulated flame-rise stopping element is made of material selected from the group consisting of a metal sheet subjected to expansion, a punched metal sheet and wire gauze.

* * * * *